US005977465A

United States Patent [19]

Piper

[11] Patent Number: 5,977,465

[45] Date of Patent: Nov. 2, 1999

[54] MALLET PERCUSSION INSTRUMENTS

[75] Inventor: John M. Piper, Omaha, Nebr.

[73] Assignee: The Selmer Company, Inc., Elkhart, Ind.

[21] Appl. No.: 08/757,764

[22] Filed: Nov. 27, 1996

[51] Int. Cl.[6] ..... G10D 13/02

[52] U.S. Cl. ..... 84/422.4; 84/402; 84/403; 84/410

[58] Field of Search ..... 84/402, 403, 422.4, 84/410, 453

[56] References Cited

U.S. PATENT DOCUMENTS

| | | | |
|---|---|---|---|
| 1,293,722 | 2/1919 | Deagan | 84/410 |
| 1,843,553 | 2/1932 | Gladestone | 84/410 |
| 1,902,614 | 3/1933 | Bower | 84/410 |
| 2,194,545 | 3/1940 | Firestone | 84/410 |
| 3,138,986 | 6/1964 | Musser | 84/410 |
| 4,848,207 | 7/1989 | Kawai | 84/403 |
| 5,686,679 | 11/1997 | Nakano et al. | 84/402 |

*Primary Examiner*—William M. Shoop, Jr.
*Assistant Examiner*—Kim Lockett
*Attorney, Agent, or Firm*—Blank Rome Comisky & McCauley LLP

[57] ABSTRACT

The instrument includes a support structure formed of telescoping legs enabling height adjustment of the bed supporting the bars. The bars are strung on lines supported on bar mounts having resilient material in engagement with the lines preventing transmission of vibration from the bars to adjacent bars and to the support structure. A dampening rail including a fluid-filled bladder extends the length of the instrument in underlying relation to the adjacent inner ends of the two rows of bars and is spring-biased into engagement with the bars. A pedal, selectively displaceable along a longitudinal support bar, is used to engage and disengage the bladder relative to the bars. The pedal includes a fulcrum assembly for adjustment of the feel of the pedal.

23 Claims, 9 Drawing Sheets

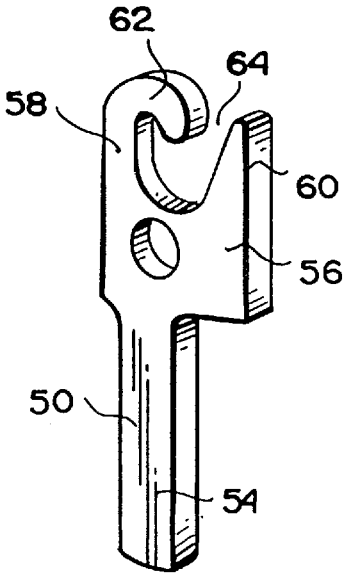
Fig. 4
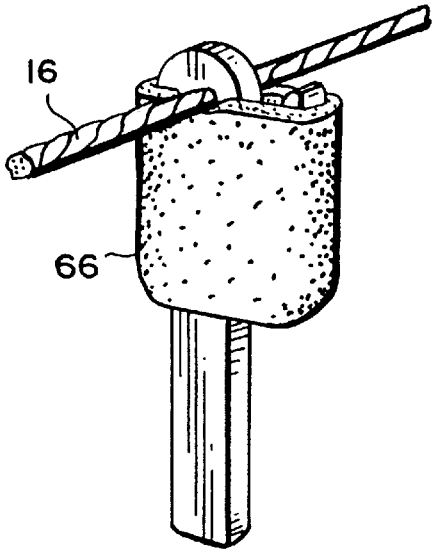
Fig. 4A
Fig. 5
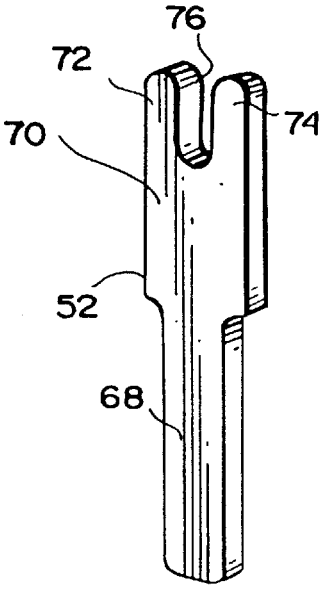
Fig. 5A
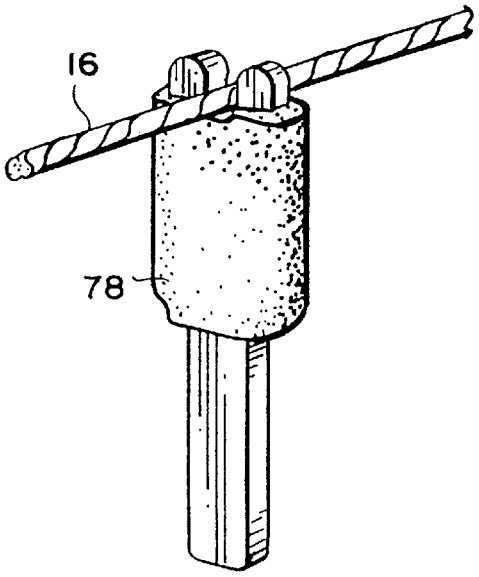

Fig. 12
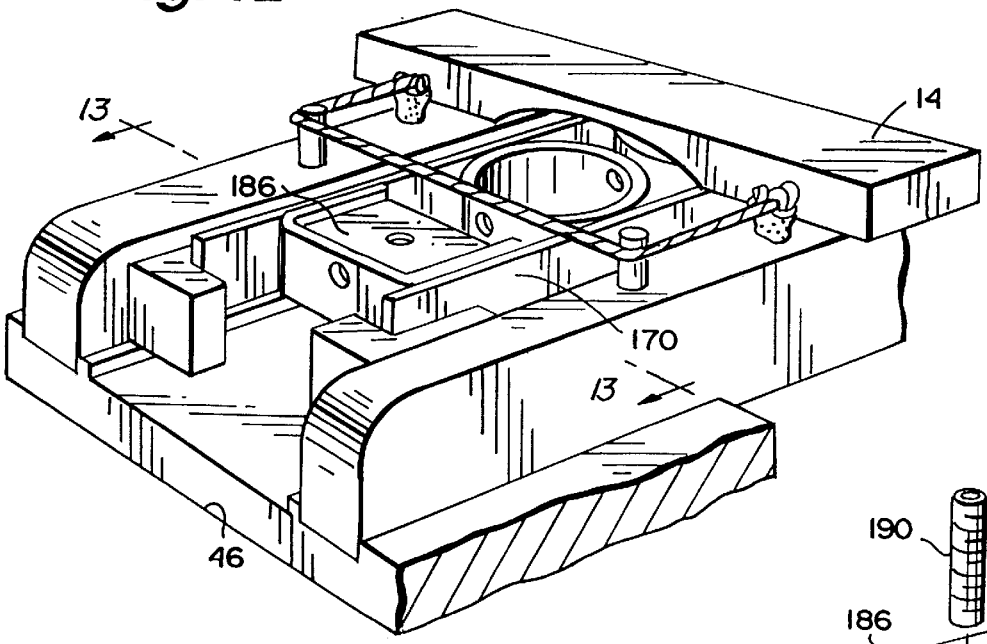
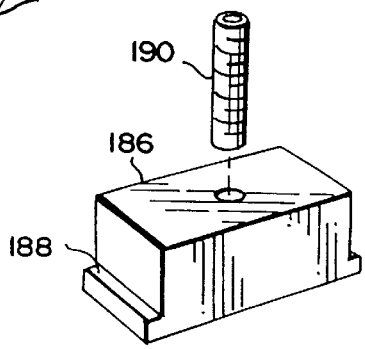
Fig. 14
Fig. 13
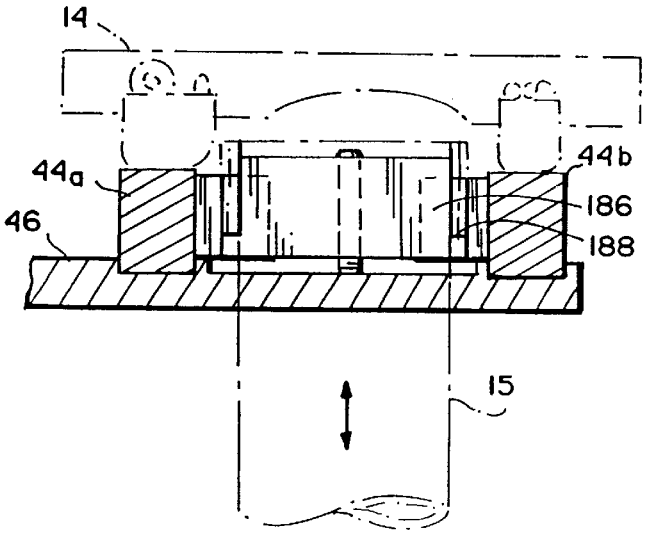

MALLET PERCUSSION INSTRUMENTS

TECHNICAL FIELD

The present invention relates to mallet percussion instruments such as vibes, xylophones and marimbas, and particularly relates to such instruments having various novel and improved constructional features facilitating the construction and portability of the instrument, improving its sound quality, rendering the instrument easier to play and eliminating sounds characteristic of conventional instrument constructions and deleterious to their musical qualities.

DISCLOSURE OF THE INVENTION

In one aspect, the present invention provides a novel and unique shock-absorbing bar mounting system which enables the bars to be suspended without transmittal of substantial vibration to the instrument supporting structure or to adjacent bars, hence minimizing or substantially eliminating non-musical sounds. To accomplish this, the present invention provides mount bars having resilient elements on which the flexible line supporting the bars may rest. With the bars isolated from the support structure by the resilient elements, the vibration of the bars transmitted along the bar support line to the resilient elements is substantially absorbed. Two types of mount bars are provided: first, a generally Y-shaped mount bar with a resilient element extending between the two upwardly-directed projections for receiving the line therebetween and, secondly, a similar bar mount with the distal end of one of the projections forming an overlying hook maintaining the line in engagement with the resilient element. With the bars arranged in two generally parallel rows on the support structure, the ends of the rows remote from one another are supported by a line extending over the resilient elements of the first bar mounts. The ends of the bars of the rows adjacent one another are supported by the line in the bar mounts having the hooks for restraining the bars when damped.

In another aspect of the present invention, there is provided a dampening rail supported by the support structure for movement between a position engaged along the underside of the adjacent ends of the bars in adjacent rows and a position spaced below those bars. Consequently, when the dampening rail engages the bars, the hooks of the bar mounts prevent the line and hence the bars from elevating above the bar mounts. Additionally, the dampening rail extends the entire length of the instrument, underlying all of the bars of the two rows at adjacent innermost ends of the bars. In accordance with the present invention, the dampening rail comprises a sealed bladder filled with fluid, such as water. Thus, the force applied to the bars when the dampening rail is raised into engagement with the bars is distributed evenly among all the bars and thus affects all bars in substantially the same manner. The dampening rail is carried on the distal end of a pair of arms pivotally secured to one side of the support structure. The support structure also carries a pair of spring bridges adjustably supported from the support structure to adjustably space the dampening rail from the underside of the bars. These bridge pieces can be independently adjusted and each carries a compression spring engaging the underside of the dampening rail whereby the pressure along the rail can be increased or decreased and evenly distributed to the bars.

A further feature of the present invention resides in a pedal arrangement which not only can be moved from side to side to accommodate the player of the instrument but also can be adjusted to change the feel of the pedal. The pedal is supported by the support frame and is locked in adjusted lateral positions along the support frame. The pedal connects with the dampening rail through an interconnecting pivotal linkage which, like the pedal per se, is laterally adjustable along the dampening rail. The interconnecting pivotal linkage can be locked in adjusted position to adjust the feel of the pedal. For example, the linkage can be adjusted so that the stroke or throw of the pedal is reduced, affording a fairly stiff dampening reaction to the bars. Conversely, the throw of the pedal can be increased to provide a softer engagement between the dampening rail and the bars.

In a still further aspect of the present invention, the resonators underlying the bars are adjustable in height relative to the bars. To accomplish this, the resonators are carried by a supporting sub-structure which, at its ends, is carried by the support structure. Interposed between the sub-structure and the support structure are adjusting elements such that the sub-structure, and hence the resonators, can be raised or lowered relative to the bars.

Additional features of the present invention will become apparent from a review of the ensuing detailed description. Such additional features include the portability of the instrument afforded by its fabrication from aluminum bar stock, using telescoping support sections to enable the height of the instrument to be adjusted. The bar stock includes slotted side walls enabling use of quick connect/disconnect mechanisms for adjusting the elements relative to one another, for example, displacing the pedal assembly laterally along the support structure into an adjusted position. Wheels are provided adjacent one end of the instrument such that, upon folding the legs into positions underlying the playing table, the instrument may be transported in a similar manner to a dolly.

In a preferred embodiment according to the present invention, there is provided a percussion instrument having a plurality of discrete elongated bars spaced one from the other and coupled to one another by a flexible line suspending the bars at each of the opposite ends of the bars from a support structure, comprising a plurality of bar mounts arranged on the support structure at locations for engagement by the flexible line between the bars and resilient elements carried by the bar mounts and forming supports for the flexible line and the bars carried thereby whereby the resilient elements substantially vibrationally isolate the bars from one another and the bars and support structure from one another upon striking and vibrating the bars.

In a further preferred embodiment according to the present invention, there is provided a percussion instrument comprising a support structure, a flexible line, a plurality of discrete elongated bars spaced from one another and supported by the flexible line adjacent the opposite ends of the bars, a plurality of bar mounts arranged on the support structure at locations for engagement by the flexible line between the bars and resilient elements carried by the bar mounts and forming supports for the flexible line and bars carried thereby whereby the resilient elements substantially vibrationally isolate the bars and the support structure from one another upon striking and vibrating the bars.

In a still further preferred embodiment according to the present invention, there is provided a percussion instrument comprising a support structure, a plurality of discrete elongated bars spaced from one another and support by the support structure, a plurality of resonator tubes spaced below the bars, a resonator tube sub-structure for supporting the resonator tubes below the bars, the sub-structure being carried by the support structure, an adjusting element between the support structure and the sub-structure for adjusting the spacing of the resonator tubes relative to the bars.

In a still further preferred embodiment according to the present invention, there is provided a percussion instrument comprising a support structure a plurality of discrete generally parallel elongated bars spaced from one another and supported by the support structure, the bars being arranged in two longitudinally extending rows thereof with the bars lying generally perpendicular to the longitudinal extent of the rows and an elongated dampening element extending generally parallel to and between the rows, the dampening element being carried by the support structure for movement between positions in and out of engagement with the bars of each row.

Accordingly, it is a primary object of the present invention to provide a novel and improved mallet percussion instrument having various novel and improved features enabling improved sound quality, ease of portability and avoidance of non-musical sounds.

BRIEF DESCRIPTION OF THE DRAWINGS

FIGS. 4 and 4A are perspective views of one type of bar mount;

FIGS. 5 and 5A are views similar to FIG. 4 illustrating a further type of bar mount;

FIG. 12 is a view similar to FIG. 10 illustrating a further form of adjustment structure for the resonators;

FIG. 13 is a cross-sectional view thereof taken generally about on line 13—13 in FIG. 12; and FIG. 14 is a perspective view of the adjusting element employed in the resonator adjustment mechanism of FIGS. 12 and 13.

BEST MODE FOR CARRYING OUT THE INVENTION

Figure 1:
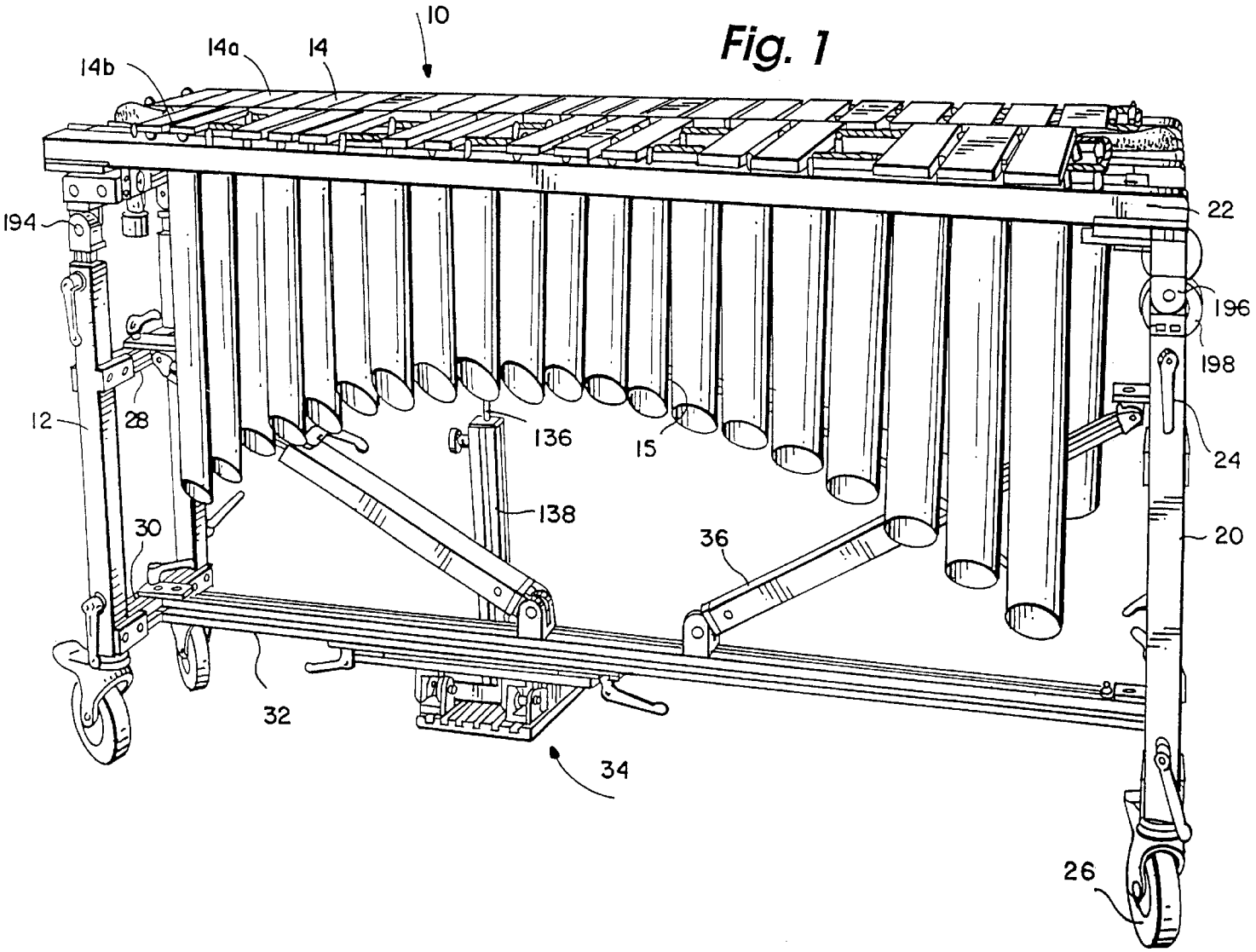
FIG. 1 is a front elevational view of a mallet percussion instrument constructed in accordance with the present invention.

Referring now to the drawings, particularly to FIG. 1, there is illustrated a percussion instrument, generally designated 10, constructed in accordance with the present invention. It will be appreciated that the percussion instrument may be any one of several different types, for example, a vibraphone, a marimba or a xylophone. The general arrangement of the instrument 10 includes a support frame 12 supporting a plurality of bars 14 arranged in two generally longitudinal parallel rows 14*a* and 14*b* with underlying resonators 15. The bars are supported on structure 12 by endless lines 16*a* and 16*b* for respective rows 14*a* and 14*b* of bars 14. The lines 16 are mounted on bar mounts 18 secured to the support structure 12 as described below.

Support structure 12 is generally formed of a plurality of lightweight, preferably aluminum tubular bars. For example, and referring to FIG. 1, a pair of vertical uprights 20 are provided at each of the opposite ends of the support structure 12, the ends being wider and narrower, respectively, as is conventional in instruments of this type, and hereafter referred to as the large and small ends, respectively. The uprights 20 are formed of telescoping sections such that the height of the instrument bed 22 supported by the end pairs of uprights 20 can be adjusted. Conventional quick locking and unlocking mechanisms are provided to adjust the extent of the telescoping sections, the sections being locked and unlocked in adjusted positions by rotation of handles 24 in a known manner. The lower ends of the end uprights 20 are provided with casters 26 so that the instrument can be moved about a floor, the casters preferably being provided with locking elements so that the position of the instrument can be fixed. The casters also are individually adjusted in height, e.g., to accommodate uneven floors. The pairs of end uprights 20 have cross members 28 and 30 (FIG. 1) to stabilize the support for the instrument bed 22. Also connected between the lowermost cross supports 30 is an elongated reinforcing support 32 which mounts a pedal assembly 34 for the instrument. The opposite ends of the longitudinally extending support 32 are releasably secured to the cross supports 30 at various positions therealong whereby the pedal assembly 34 can be adjustably positioned relative to the front and back sides of the instrument, i.e., adjusted forwardly and rearwardly as necessary and desirous. Diagonally extending telescopic support members 36 are pivotally connected at one end to the long support 32 and at their opposite ends to the upper cross support 28 of the end pair of uprights 20.

Figure 2:
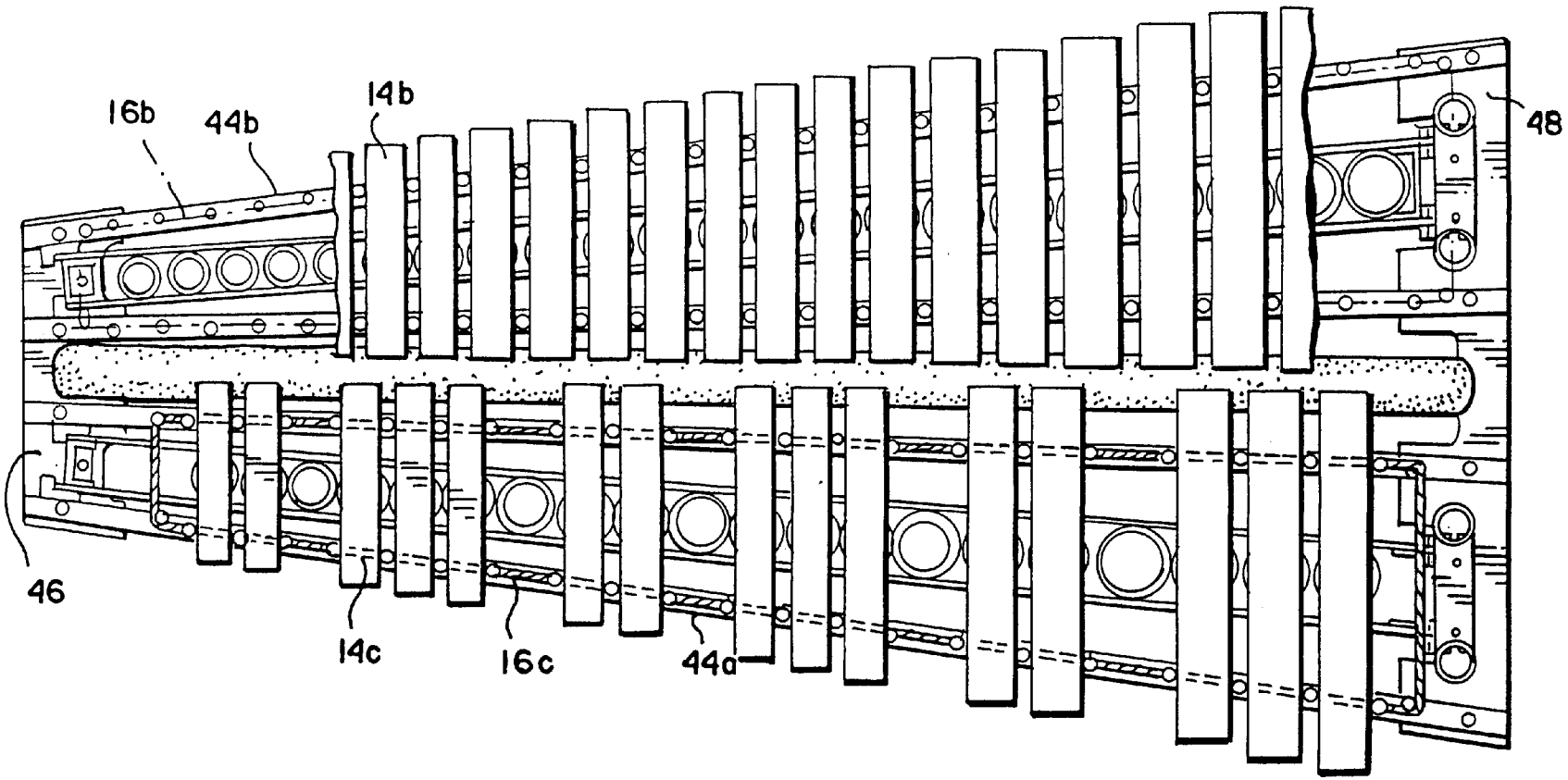
FIG. 2 is a top plan view thereof.
Figure 6:
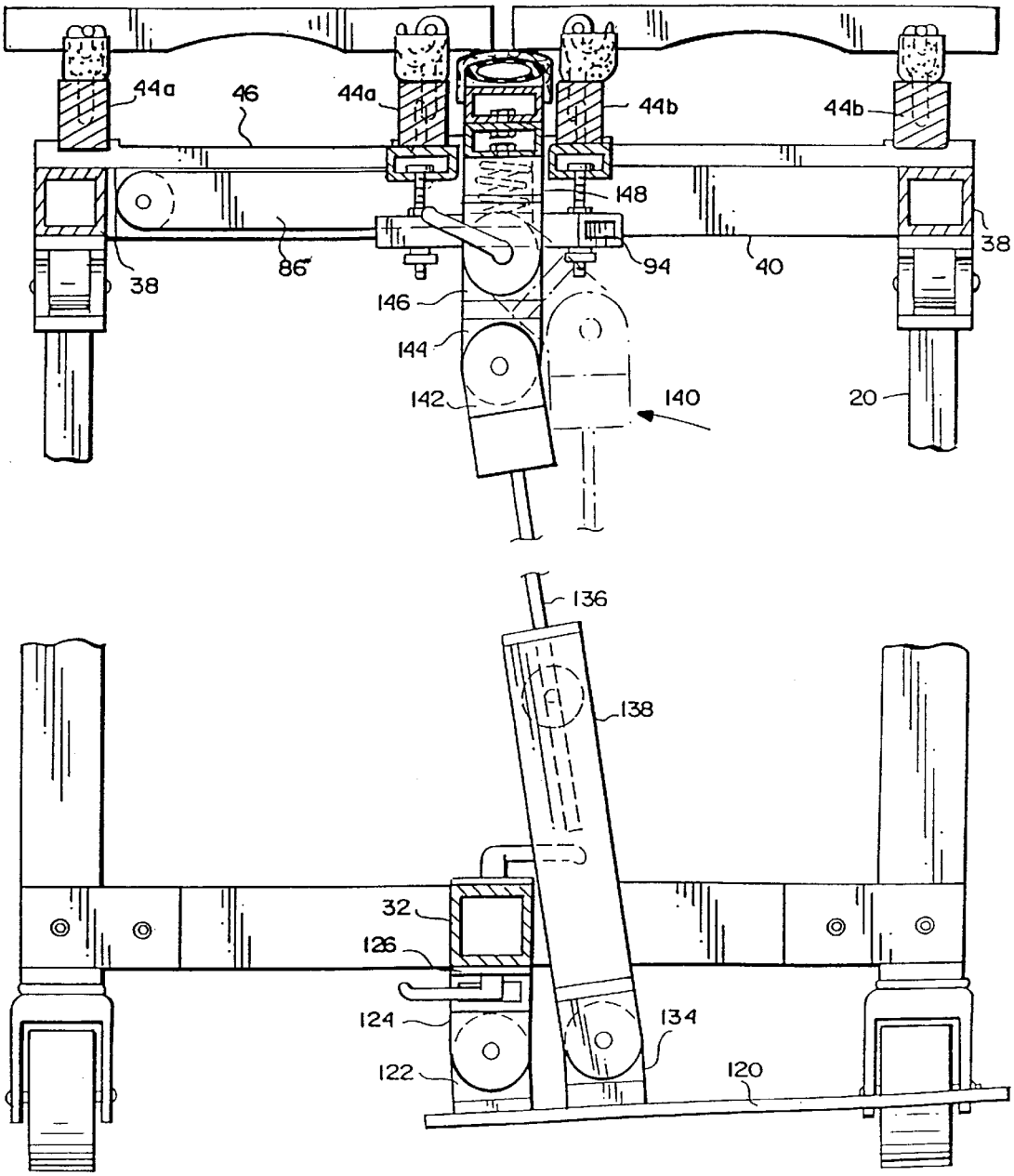
FIG. 6 is an enlarged fragmentary view with portions broken out and in cross-section taken generally about on line 6—6 in FIG. 3.
Figure 7:
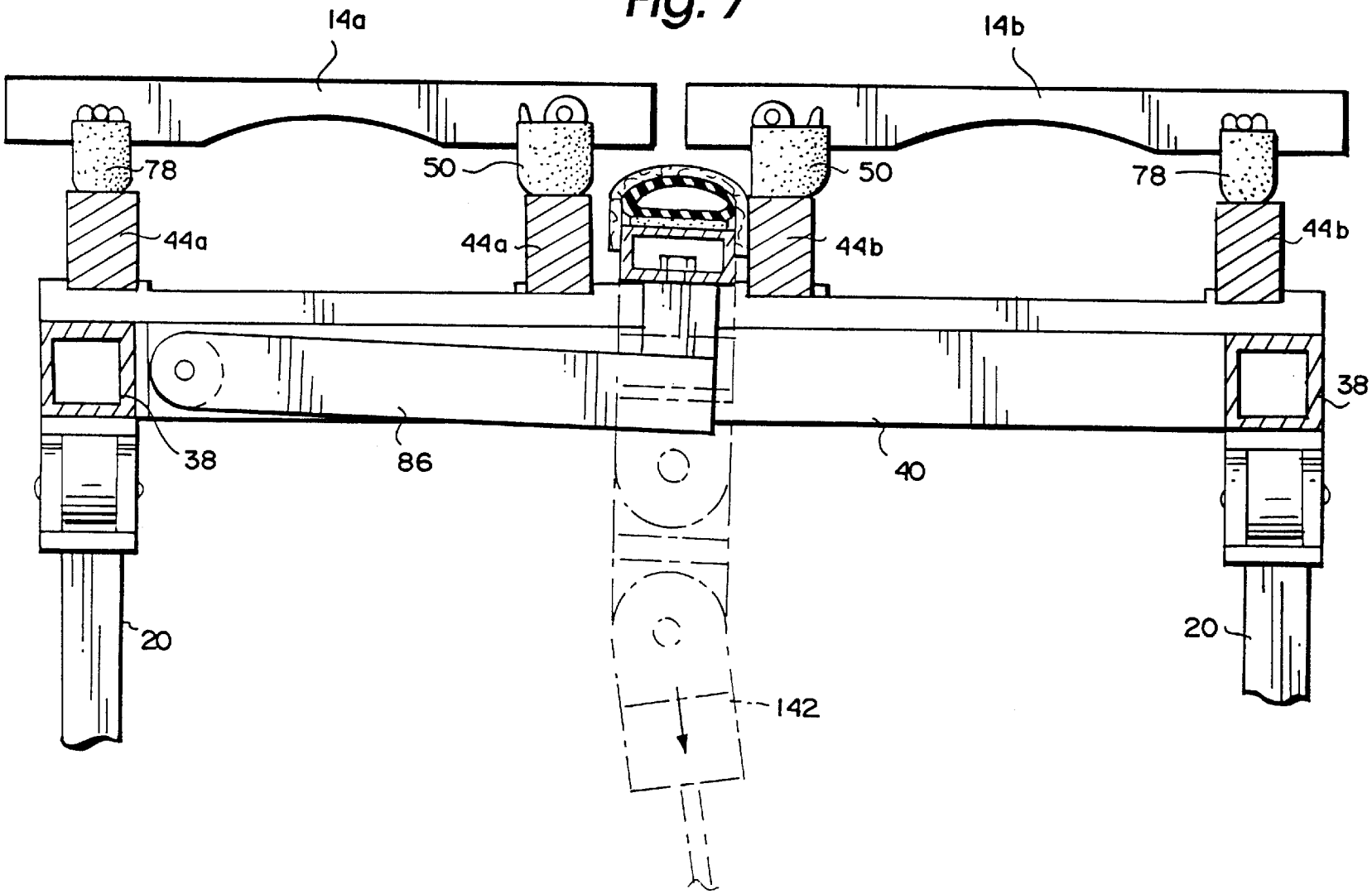
FIG. 7 is a view similar to FIG. 6 taken generally about on line 7—7 in FIG. 3.
Figure 9:
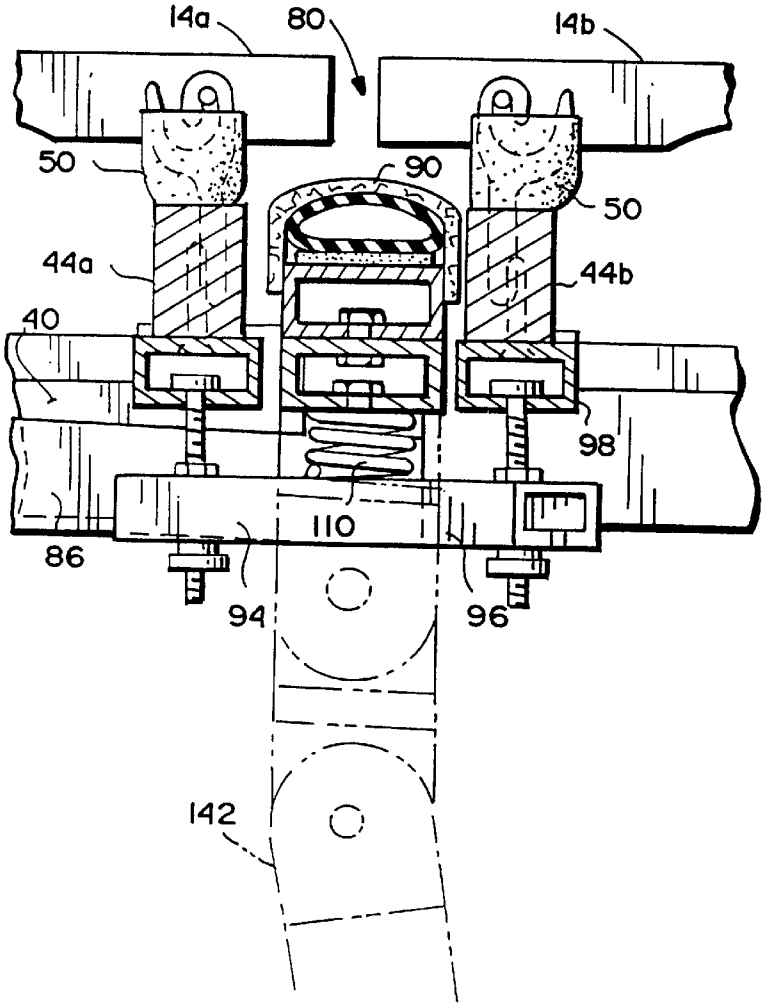
FIGS. 8 and 9 are fragmentary enlarged cross-sectional views illustrating the dampening rail and pressure adjustable support structure therefor.

As best illustrated in FIGS. 1 and 6, the end uprights 20 are pivotally coupled to a pair of front and back longitudinally extending supports 38 forming part of the support bed 22 for the instrument 10. The supports 38 are interconnected at opposite ends by cross supports 40 forming the substantially rigid bed 22 of the instrument. Bed 22 also includes a pair of bar mounting rails 44*a* for the front row of bars 14*a* and a pair of rails 44*b* for the rear bars 14*b*. As illustrated in FIG. 2, the bar support rails 44*a* diverge from one another from the small end to the large end of the instrument, while the rails 44*b* similarly diverge one from the other from the small to the large end of the instrument. The bar support rails 44 are each mounted in cross rail holders or plates 46 and 48 at the opposite small and large ends, respectively, of the instrument 10. The bar rail holders 46 and 48, as illustrated in FIG. 6, are grooved for receiving the lower sides of bar support rails 44*a* and 44*b*, the holders 46 and 48 being directly connected to and supported by the longitudinal and cross supports 38 and 40, respectively, of the support structure 12.

Referring to FIGS. 4–7, each of the bar mounting rails 44 has a plurality of longitudinally spaced openings through its top side for receiving the lower or shank ends of bar mounts 50 and 52. Bar mounts 50 and 52 are for purposes of supporting the line 16 which, in turn, supports the individual bars 14. It will be appreciated that the line 16 may comprise an endless loop for each row of bars and is preferably formed of a textile material. The bar mounts 50 and 52 are specifically designed to dampen the transmission of vibration from the bars to the support structure or to adjacent bars when the bars are struck by a mallet. For reasons which will become clear from the ensuing description, bar mounts 50 and 52 are of two different types: a first type being utilized along the interior or adjacent bar support rails 44*a* and 44*b*, while the second type 52 is used along the exterior bar support rails 44*a* and 44*b*. The interior bar mounts 50 each include a depending shank 54, generally rectilinear in configuration, and a head 56 formed, in part, by a pair of upwardly projecting, laterally spaced fingers 58 and 60. The upper end of finger 58 is reversely curved to form a hook 62 which extends substantially halfway across the gap between fingers 58 and 60 and forms an opening 64 with the opposed finger 60 to the area between fingers 58 and 60 below hook 62. A sleeve 66 formed of a resilient material such as latex rubber is received about the head 56 and overlies a portion of the gap between fingers 58 and 60. With the line 16 received in each opening 64 and within the concave portion of hook 62, sleeve 66 is disposed about the head 56 such that the line 16 rests on the upper margin of sleeve 66.

Referring to FIGS. 5 and 5A, the bar mount 52 for the outside bar mount rails 44*a* and 44*b* includes a shank 68 similar to shank 54, a head 70 and a pair of upwardly projecting, laterally spaced fingers 72 and 74 forming a slot 76 therebetween for receiving a line 16. Like the head 56, the head 70 includes a resilient sleeve 78. Thus, when the line 16 is received within the slot 76, the upper margins of the resilient sleeve 78 support line 16. The support of line 16 by both resilient sleeves 68 and 78 isolates the vibration transmitted from a bar struck by a mallet along the line 16 from adjacent bars and from the support structure 12.

Referring now to FIGS. 6–9, there is illustrated a dampening rail, generally indicated 80, movable between positions engaging and disengaged from the underside of the inner ends of bars 14*a* and 14*b*, the dampening rail 80 lying between the inner bar support rails 44*a* and 44*b*. The dampening assembly includes a pair of elongated structural tubes 82 and 84 superposed one over the other and secured to one another, for example, by bolts. The tubes 82 and 84 are positioned along a central longitudinal portion of the instrument by a pair of transversely extending supports 86 pivoted at one end to the cross supports 40 and secured at their opposite ends to the lower tube 84, enabling the tubes 82 and 84 to move between the positions illustrated in FIGS. 8 and 9.

Along the upper side of the upper tube 82 is a bladder 88 preferably filled with a liquid such as water and which bladder 88 extends the length of the instrument, including between opposed ends (interior ends) of the bars of the row thereof. The bladder is a sealed container such that pressures exerted on the bladder at any location therealong are immediately transmitted throughout the length of the bladder whereby the pressure along the bladder is equalized. Overlying the bladder 88 is a pad 90 of cloth or felt material and which pad 90 engages the underside of the bars 14 of the rows of bars 14*a* and 14*b*. For reasons discussed below, the lower tube 84 of the dampening assembly 80 has an elongated slot 92 formed along its underside for facilitating releasable securement of the pedal assembly 34 to the dampening rail 80.

Figure 3:
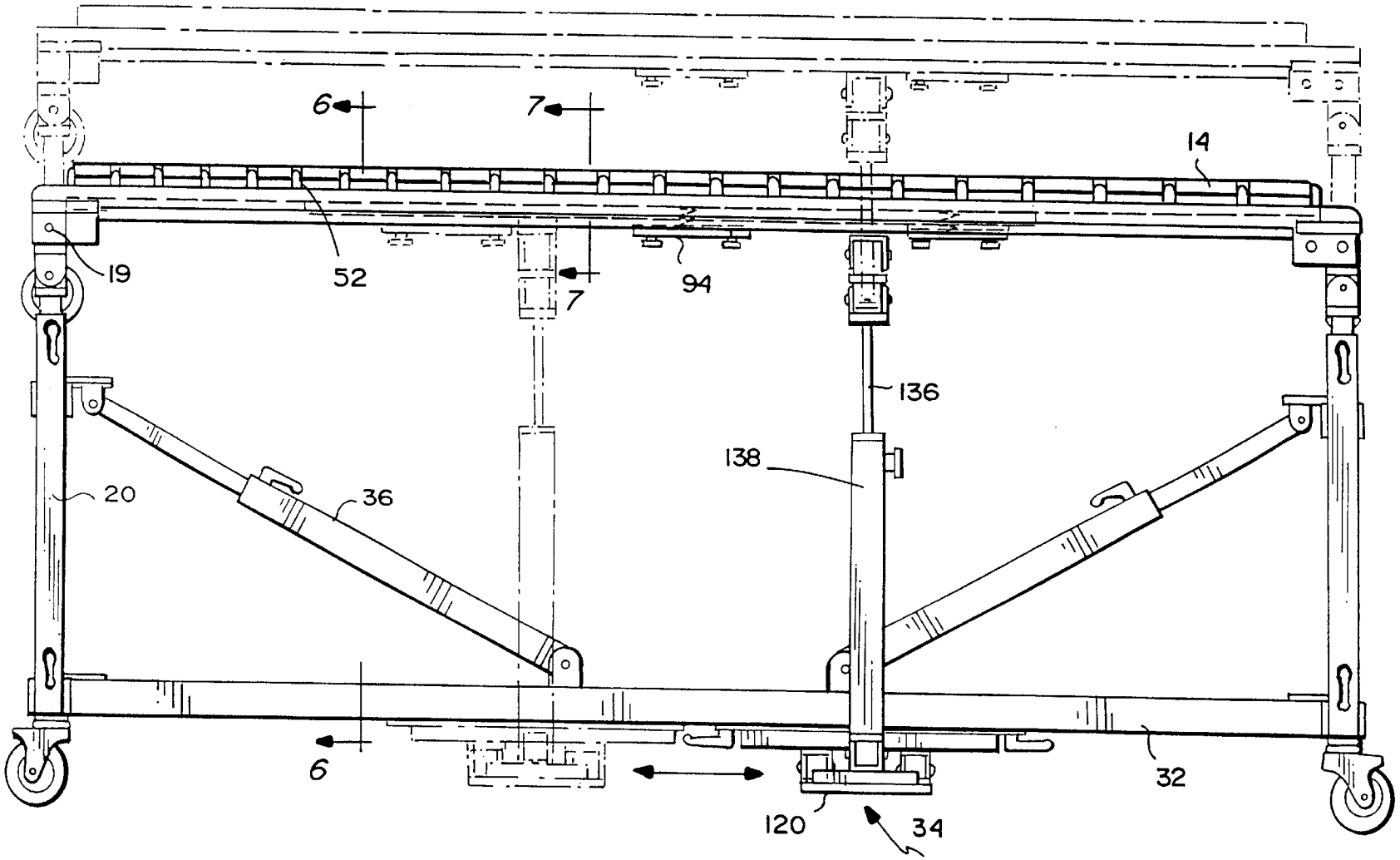
FIG. 3 is a side elevational view with the resonators omitted, illustrating the support structure and height adjustment features.
Figure 8:
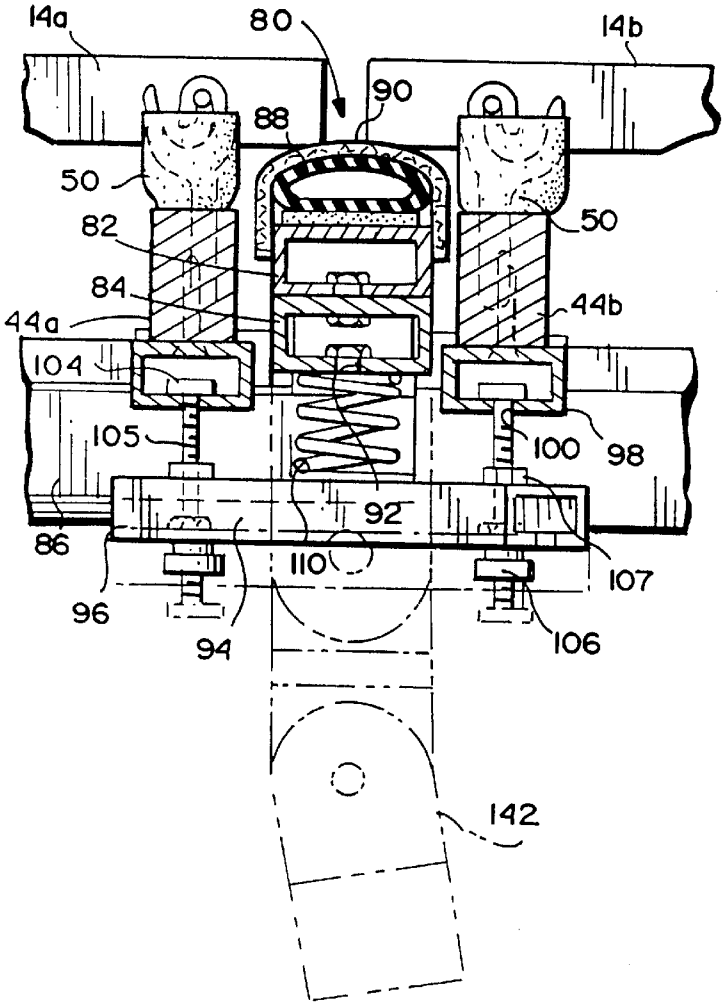
Figure 10:
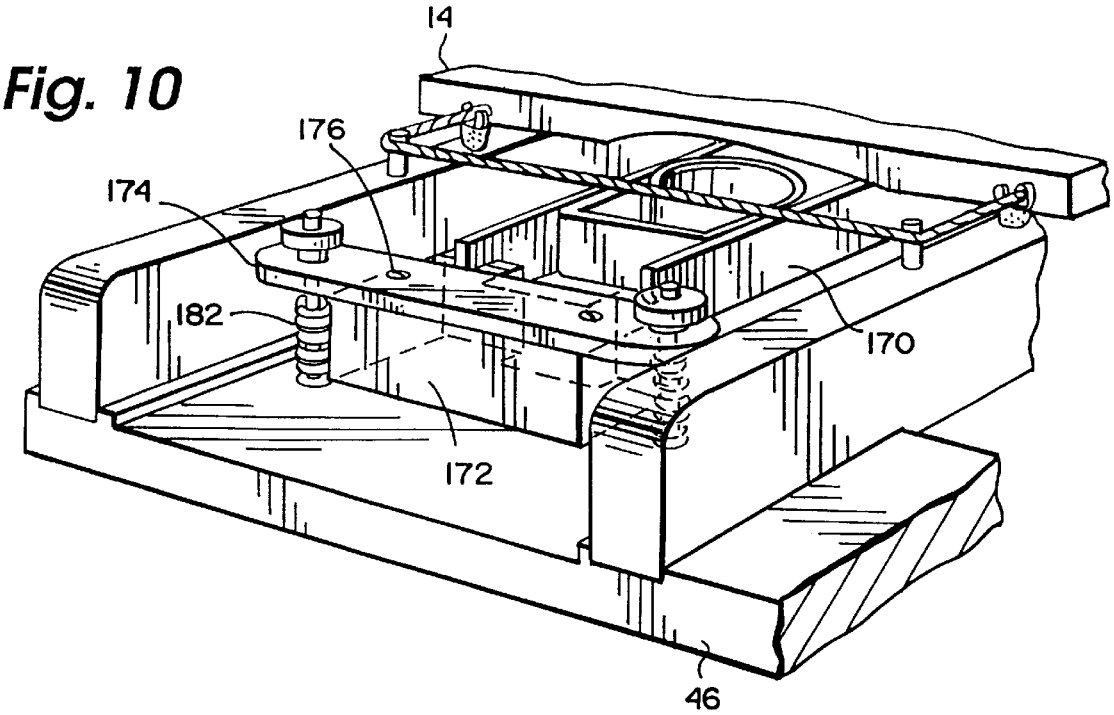
FIG. 10 a fragmentary perspective view illustrating the sub-structure for adjustably carrying the resonators on the support structure of the instrument.

To support the dampening rail 80 between the interior bar mount rails 44*a* and 44*b*, a pair of spring bridges 94 are provided along the underside of the bed 22 for supporting and biasing the dampening rail 80 into the position engaged along the underside of the bars, as illustrated in FIG. 8. Each of the spring bridges 94 includes a short cross piece 96 of tubular construction dependently and adjustably secured below a pair of elongated longitudinally extending beams 98 secured along the undersides of the inner bar support rails 44*a* and 44*b*. The bridges 98 thus straddle the dampening rail 80. Each of the beams 98 is of rectilinear cross section having a slot 100 formed along its underside. Elongated bolts 102 having heads 104 lying within the beams 98 dependently support the spring bridges 96 in adjusted elevational position relative to tube 84. Thus, by using various nuts and lock nuts, for example, lock nuts 106 and jam nuts 107, the cross bridges 96 may span between opposite sides of the dampening rail 80 below the tube 84 at adjustable elevational and longitudinal positions relative to the beams 98. Each of the bridges 96 carries a coil spring 110 which engages between the bridge 96 and the underside of tube 84, biasing the tubes and the bladder in a vertically upward direction to engage the pad 90 against the underside of the bars 14. Consequently, it will be appreciated that the support arms 86 position the dampening rail 80 transversely of the instrument 10, while the bridges 96 and springs 110 carried thereby bias the dampening rail 80 for movement upwardly into engagement with the bars. By appropriate use of the bolts 102, the bridges can be located at longitudinally spaced positions along the instrument, as best illustrated in FIG. 3.

The pedal assembly 34 for displacing the dampening rail 80 into and out of engagement with the inner ends of the bars is best illustrated in FIG. 6. The pedal assembly 34 is longitudinally displaceable along the support bar 32 into a longitudinally adjusted position. Quick lock and unlocking mechanisms, of conventional construction, may be used to lock and unlock the pedal assembly 34 in a longitudinally adjusted position. The pedal assembly 34 includes the pedal plate 120 which mounts adjacent its rear edge at longitudinally spaced positions a pair of lugs 122. These upstanding lugs 122 are pivotally secured to a pair of lugs 124 dependent from a plate 126 slidable along the support 32. While not shown, the support 32 has a longitudinal groove or T-slot along its underside for receiving mating projections, also not shown, on plate 126 which can be loosened to permit longitudinal sliding of the pedal assembly along the length of the instrument and tightened to lock the pedal assembly in adjusted longitudinal positions along support 32. Centrally of the foot pedal 120 and slightly forwardly of the lugs 122 is a lug 134 to which is pivotally coupled a rod 136 surrounded by a square tube 138. The rod 136 and tube 138 are telescopic, enabling the pedal assembly to operate at different adjusted heights of the instrument. The upper end of the rod 136 is coupled to a fulcrum assembly, generally designated 140. The fulcrum assembly includes a lower hinge 142 coupled to rod 136, an intermediate link 144 and an upper fulcrum 146 pivotally connected to link 144. Fulcrum 146 is secured to a depending bracket 148, in turn secured to the underside of lower tube 84. The pivotal connections between the link 144 and fulcrums 142 and 146 can be locked and unlocked in adjusted positions, for example, as illustrated by the full and dashed lines in FIG. 6. It will be appreciated that by depressing pedal 120, the dampening assembly, including the bladder 88 and dampening pad 90 are lowered, i.e., disengaged from the underside of the bars 14*a* and 14*b*. By releasing the foot pedal 120, the springs 110 urge the dampening bladder 88 and pad 90 into engagement with the undersides of the bars 14*a* and 14*b*. By angularly adjusting the fulcrum assembly 140, for example, from the full-line to the dashed-line position illustrated in FIG. 6, the "feel" of the pedal may be altered. More particularly, the throw or displacement of the pedal 120 is greater and the feel is stiffer. Conversely, with the fulcrum assembly 140 in the full-line position illustrated in FIG. 6, the pedal has quick response in displacing the dampening assembly from the bars.

Figure 11:
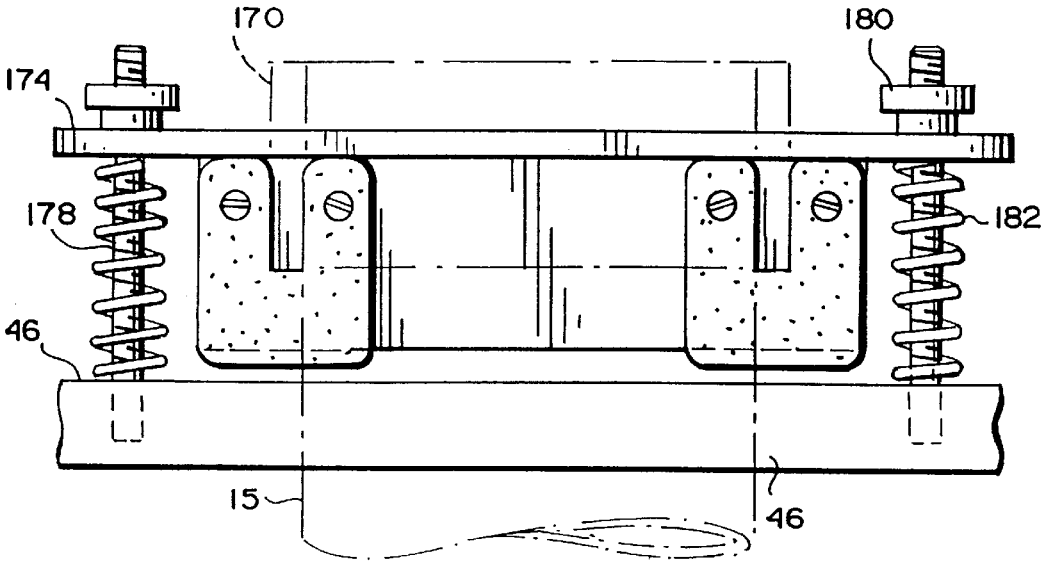
FIG. 11 is a fragmentary end elevational view thereof.
Figure 2:
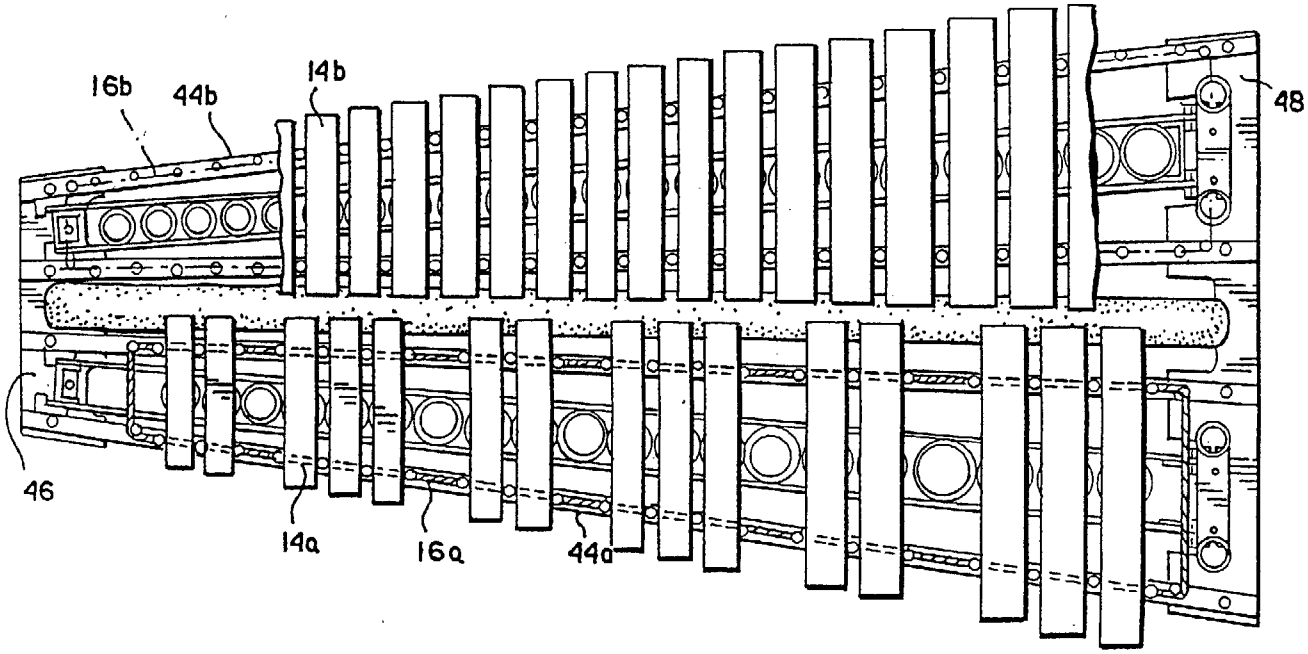
Figure 9:
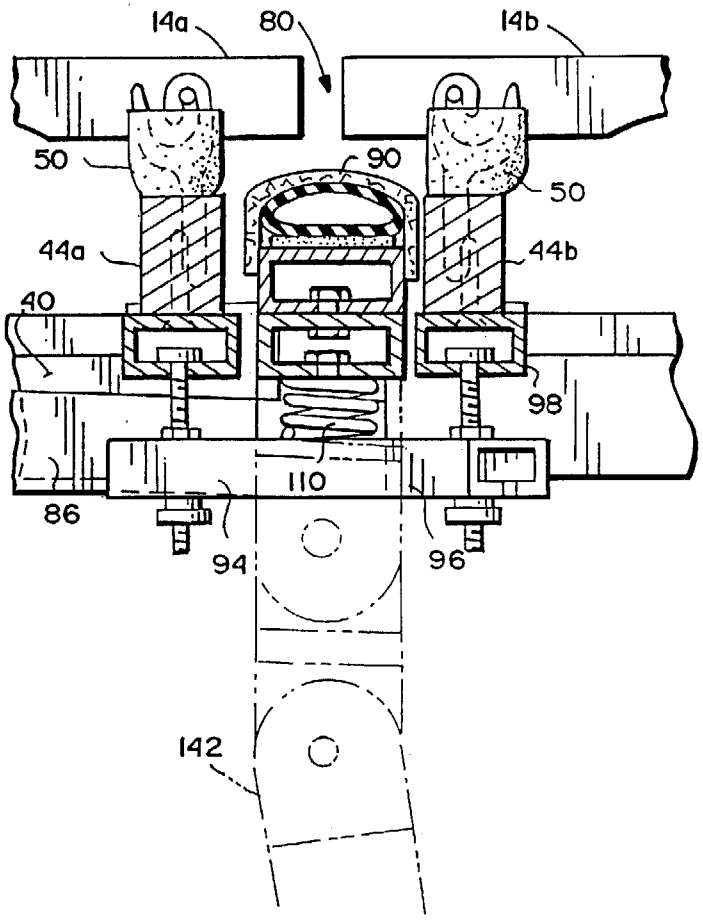
Figure 8:
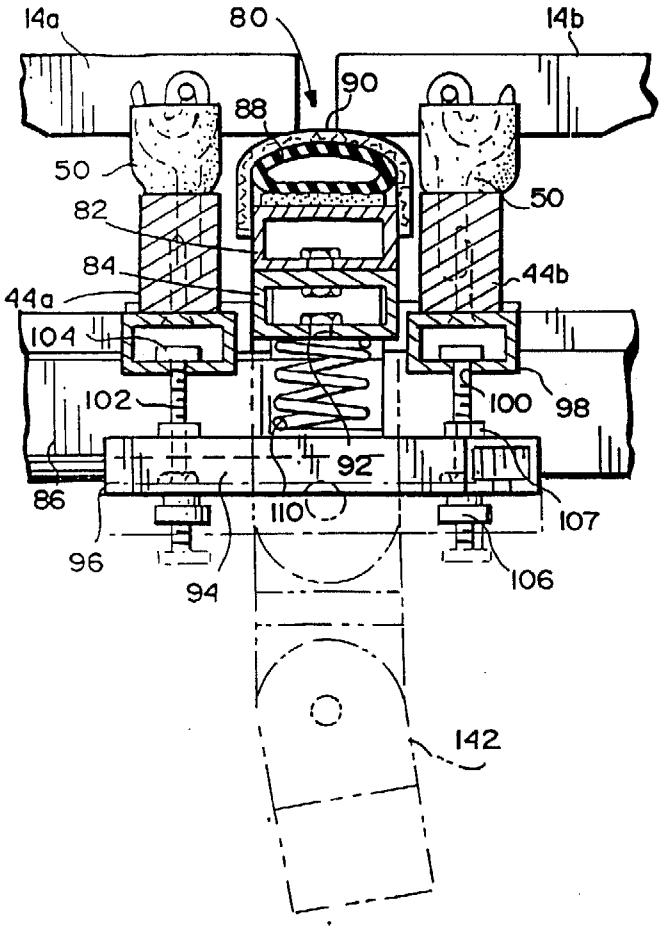

In another aspect of the present invention, referring to FIGS. 10–14, the resonators 15 are mounted at elevationally adjusted positions relative to the bars 14. To accomplish this, the resonators are suspended by a support sub-structure including a pair of longitudinally extending laterally spaced resonator support rails 170. The ends of rails 170 are, in turn, disposed in slots in resonator mounting beds 172 at the opposite ends of the instrument, respectively. Each mounting bed 172 is secured to the underside of an elevationally adjustable support plate 174, for 15 example, by screws 176. The support plate 174, in turn, is carried on bolts 178 (FIG. 11). The height of the support plate 174 above the holder 46 and hence the height of the bed 172 at the opposite ends of the instrument may be adjusted by adjusting, tightening down or loosening the nuts 180 against the bias of springs 182 disposed between support plate 174 and holder 46.

In a further form of adjustment illustrated in FIGS. 12–14, the ends of the resonator support rails 170 are cabried by an adjustment block 186. As illustrated in FIG. 14, the rails 170 seat on flanges 188 formed along the lower side of block 186. The block includes a set screw 190 threaded through block 186 for engagement with the surface of holder 46. It will be appreciated that by threading or unthreading the set screw 190, the block 186 may be raised or lowered relative to the holder 46 to adjust the height of the resonators 15 relative to the underside of the bars 14.

It will be appreciated that the instrument 10 hereof can be readily and easily folded into a transportable position. To accomplish that, the bars 14 are simply lifted from their bar mounts to remove the bars from the bed 22. The lines 16 underlying the hook 62 of the bar mounts 54 must first, of course, be displaced into the gap 64 to enable the bars to be lifted from the mounts. The longitudinal support rail 32 is then disconnected from the lower cross supports 30 and the diagonal supports 36 are disconnected from the upper cross supports 28. As illustrated in FIG. 1, the upper ends of the telescoping portions of the vertical uprights 20 are pivotally secured along the underside of the bed 22. Consequently, the small end can be pivoted, for example, about the pivot axis 194 into substantial parallel relation with the bed 22. Likewise, the large end uprights 20 can be pivoted about axes 196 into underlying relation to bed 22 and the opposite pair of support legs. A pair of dolly wheels 198 are pivotally secured to the bed 22 such that the folded instrument can be inclined with the wheels 198 engaging the ground. It will be appreciated that the resonators 15 and the supporting sub-structure may likewise be removed prior to folding the instrument for transport.

Further features of the invention include the substantially all-aluminum construction whereby the instrument is substantially light in weight. The relatively moving parts are encapsulated, preferably in a material such as Teflon or some other high-density plastic to ensure smooth noiseless operation. In this manner, various non-musical sounds which would otherwise be attendant to the playing of the instrument are eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a percussion instrument having a plurality of discrete elongated bars spaced one from the other and coupled to one another by a flexible line suspending the bars at each of the opposite ends of the bars from a support structure, comprising:

a plurality of bar mounts arranged on the support structure at locations for engagement by the flexible line between the bars; and resilient elements carried by said bar mounts and forming supports for the flexible line and the bars carried thereby whereby the resilient elements substantially vibrationally isolate the bars from one another and the bars and support structure from one another upon striking and vibrating the bars.

2. Apparatus according to claim 1 wherein each of the bar mounts of a first set of said plurality of said bar mounts includes a pair of spaced upstanding projections and a resilient element extending between the projections for receiving the line whereby the line rests on the resilient elements between the projections.

3. Apparatus according to claim 1 wherein each bar mount of a second set of said plurality of bar mounts includes a resilient element for receiving the line and a hook overlying said resilient element whereby the line rests on the resilient element and said hook substantially precludes elevating movement of the line from the resilient element.

4. Apparatus according to claim 1 wherein each of the bar mounts of a first set of said plurality of said bar mounts includes a pair of spaced upstanding projections and a resilient element extending between the projections for receiving the line whereby the line rests on the resilient elements between the projections, each bar mount of a second set of said plurality of bar mounts including a resilient element for receiving the line and a hook overlying said resilient element whereby the line rests on the resilient element and said hook substantially precludes elevating movement of the line from the resilient element.

5. A percussion instrument comprising:

a support structure;

a flexible line;

a plurality of discrete elongated bars spaced from one another and supported by said flexible line adjacent the opposite ends of said bars;

a plurality of bar mounts arranged on the support structure at locations for engagement by the flexible line between said bars; and resilient elements carried by said bar mounts and forming supports for the flexible line and bars carried thereby whereby the resilient elements substantially vibrationally isolate the bars and the support structure from one another upon striking and vibrating the bars.

6. An instrument according to claim 5 wherein each of the bar mounts of a first set of said plurality of said bar mounts includes a pair of spaced upstanding projections and a resilient element extending between the projections for receiving the line whereby the line rests on the resilient elements between the projections.

7. An instrument according to claim 5 wherein each bar mount of a second set of said plurality of bar mounts includes a resilient element for receiving the line and a hook overlying said resilient element whereby the line rests on the resilient element and said hook substantially precludes elevating movement of the line from the resilient element.

8. An instrument according to claim 5 wherein each of the bar mounts of a first set of said plurality of said bar mounts includes a pair of spaced upstanding projections and a resilient element extending between the projections for receiving the line whereby the line rests on the resilient elements between the projections, each bar mount of a second set of said plurality of bar mounts including a resilient element for receiving the line and a hook overlying said resilient element whereby the line rests on the resilient element and said hook substantially precludes elevating movement of the line from the resilient element.

9. An instrument according to claim 8 wherein said bars are arranged on said support structure in two elongated substantially side-by-side rows with the bars in each row extending generally perpendicular to the longitudinal extent of the rows, and a dampening element movable between positions in and out of engagement with the bars of each row.

10. An instrument according to claim 9 wherein said dampening element includes an elongated pad filled with a fluid and carried by said support structure for movement from a non-engaging position spaced from an underside of said bars into the position engaging the bars along their underside.

11. An instrument according to claim 9 wherein said second set of bar mounts lie along adjacent ends of the bars of the two rows thereof and said dampening element in its engaged position with said bars engages said adjacent ends thereof whereby said hooks prevent the line from lifting off the support structure upon movement of the dampening element into engagement with the bars.

12. An instrument according to claim 9 including a foot-operated pedal for raising said dampening element into said engaged position and lowering said dampening element into said out-of-engaged position, said pedal being adjustable for movement in a direction generally parallel to the two rows of bars for positioning the pedal in a selected location relative to the rows of bars.

13. Apparatus according to claim 9 including a foot-operated pedal, a pivotal joint coupling said pedal and said dampening element such that downward and upward movement of the pedal causes respective downward and upward movement of the dampening element.

14. Apparatus according to claim 5 wherein said bars are arranged on said support structure in two elongated substantially side-by-side rows with the bars in each row extending generally perpendicular to the longitudinal extent of the rows, and a dampening element movable between positions in and out of engagement with the bars of each row, including a foot-operated pedal for raising said dampening element into said engaged position and lowering said dampening element into said out-of-engaged position, said linkage interconnecting said pedal and said dampening element being adjustable to adjust the throw of the pedal and the response of the dampening element to the pedal such that the greater the throw of the pedal, the less stiff the response.

15. Apparatus according to claim 5 wherein said bars are arranged on said support structure in two elongated substantially side-by-side rows with the bars in each row extending generally perpendicular to the longitudinal extent of the rows, and a dampening element movable between positions in and out of engagement with the bars of each row, said dampening element including an elongated pad filled with a fluid and carried by said support structure for movement from a non-engaging position spaced from an underside of said bars into the position engaging the bars along their underside, a support for said dampening element including a pair of longitudinally spaced arms pivotally connected adjacent one end to said support structure and coupled to said dampening element adjacent their distal ends, at least one spring carried by said support structure for biasing said dampening element into engagement with said bars and a pedal connected to said dampening element for displacing said element against the bias of said spring and in a direction away from said bars.

16. Apparatus according to claim 5 including a plurality of resonator tubes spaced below said bars, a resonator tube sub-structure for supporting said resonator tubes below said bars, said sub-structure being carried by said support structure and an adjusting element between said support structure and said sub-structure for adjusting the spacing of said resonator tubes relative to said bars.

17. A percussion instrument comprising:

a support structure;

a plurality of discrete generally parallel elongated bars spaced from one another and supported by said support structure, said bars being arranged in two longitudinally extending rows thereof with the bars lying generally perpendicular to the longitudinal extent of said rows; and an elongated dampening element extending generally parallel to and between said rows, said dampening element being carried by said support structure for movement between positions in and out of engagement with the bars of each row.

18. An instrument according to claim 17 wherein said dampening element includes an elongated pad filled with a fluid and carried by said support structure for movement from a non-engaging position spaced from an underside of said bars into the position engaging the bars along their underside.

19. An instrument according to claim 17 wherein said dampening element includes a fluid-filled bladder.

20. An instrument according to claim 17 including a pivoted member for locating said dampening element between said rows of bars, support members carried by said support structure below said bars and a spring carried by each support member and engaging said dampening element to maintain said dampening rail in engagement with said bars.

21. An instrument according to claim 20 including a foot-operated pedal for raising said dampening element into engaged position and lowering said dampening element into said out-of-engaged position.

22. An instrument according to claim 17 including a plurality of resonator tubes spaced below said bars, a resonator tube sub-structure for supporting said resonator tubes below said bars, said sub-structure being carried by said support structure and an adjusting element between said support structure and said sub-structure for adjusting the spacing of said resonator tubes relative to said bars.

23. A percussion instrument comprising:

a support structure;

a plurality of discrete elongated bars spaced from one another and supported by said support structure;

a plurality of resonator tubes spaced below said bars;

a resonator tube sub-structure for supporting said resonator tubes below said bars;

said sub-structure being carried by said support structure; and an adjusting element between said support structure and said sub-structure for adjusting the spacing of said resonator tubes relative to said bars.

* * * * *

UNITED STATES PATENT AND TRADEMARK OFFICE
CERTIFICATE OF CORRECTION

PATENT NO. : 5,977,465

DATED : NOVEMBER 2, 1999

INVENTOR(S) : JOHN M. PIPER

It is certified that error appears in the above-identified patent and that said Letters Patent is hereby corrected as shown below:

The drawing sheets consisting of Figs. 2 and 8, should be deleted to be replaced with the drawing sheets, consisting of Figs. 2 and 8, as shown on the attached pages.

Signed and Sealed this

Twenty-sixth Day of December, 2000

*Attest:*

Q. TODD DICKINSON

*Attesting Officer*

*Director of Patents and Trademarks*